US009933720B2

(12) United States Patent
Kayamori et al.

(10) Patent No.: US 9,933,720 B2
(45) Date of Patent: Apr. 3, 2018

(54) ELECTROSTATIC IMAGE DEVELOPING TONER

(71) Applicant: Konica Minolta, Inc., Tokyo (JP)

(72) Inventors: Takanari Kayamori, Kawasaki (JP); Masaharu Matsubara, Hachioji (JP); Naoya Tonegawa, Sagamihara (JP); Kouji Sekiguchi, Tokyo (JP); Atsushi Iioka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/401,494

(22) Filed: Jan. 9, 2017

(65) Prior Publication Data

US 2017/0227872 A1 Aug. 10, 2017

(30) Foreign Application Priority Data

Feb. 4, 2016 (JP) ..... 2016-019395

(51) Int. Cl.

| | |
|---|---|
| ***G03G 9/087*** | (2006.01) |
| ***G03G 9/09*** | (2006.01) |
| ***G03G 9/08*** | (2006.01) |

(52) U.S. Cl.

CPC ..... *G03G 9/091* (2013.01); *G03G 9/0819* (2013.01); *G03G 9/0827* (2013.01); *G03G 9/08702* (2013.01); *G03G 9/08711* (2013.01); *G03G 9/08755* (2013.01); *G03G 9/08791* (2013.01); *G03G 9/08797* (2013.01); *G03G 9/0924* (2013.01)

(58) Field of Classification Search

CPC . G03G 9/08755; G03G 9/08708; G03G 9/091

See application file for complete search history.

(56) References Cited

U.S. PATENT DOCUMENTS

| | | | | |
|---|---|---|---|---|
| 2003/0190544 | A1* | 10/2003 | Tanaka | G03G 9/08782 430/108.23 |
| 2005/0202331 | A1* | 9/2005 | Hirose | G03G 9/0806 430/108.2 |
| 2005/0227157 | A1* | 10/2005 | Shirai | G03G 9/08755 430/106.1 |
| 2014/0093289 | A1* | 4/2014 | Ishii | G03G 15/2025 399/329 |
| 2015/0056549 | A1* | 2/2015 | Ikeda | G03G 9/08755 430/108.22 |

FOREIGN PATENT DOCUMENTS

| | | | |
|---|---|---|---|
| JP | 2000075552 | A | 3/2000 |
| JP | 2004109310 | A | 4/2004 |
| JP | 2006313302 | A | 11/2006 |
| JP | 2013257415 | A | 12/2013 |
| JP | 2014186194 | A | 10/2014 |

* cited by examiner

*Primary Examiner* — Peter L Vajda
(74) *Attorney, Agent, or Firm* — Lucas & Mercanti, LLP

(57) ABSTRACT

An object of the present invention is to provide an electrostatic image developing toner including toner particles containing: an amorphous resin including an amorphous vinyl resin; and a crystalline resin, wherein the toner particles contain: a coloring agent including C. I. Pigment Yellow 74; and alkoxy aniline with an amount in the range of 0.1 to 50.0 mass ppm in the toner particles.

7 Claims, No Drawings

ELECTROSTATIC IMAGE DEVELOPING TONER

This application is based on Japanese Patent Application No. 2016-019395 filed on Feb. 4, 2016 with Japan Patent Office, the entire content of which is hereby incorporated by reference.

TECHNICAL FIELD

The present invention relates to an electrostatic image developing toner. More specifically, the present invention relates to an electrostatic image developing toner excellent in low-temperature fixing property (fixability) and coloring power with suppressed toner scattering.

BACKGROUND

An electrophotographic image forming apparatus forms an image using an electrostatic image developing toner (hereafter, it may be simply called as a toner) on a transfer medium such as paper, then, the formed toner image is fixed.

As a fixing method, a heat roller fixing method is widely used. In this method, the transfer medium after formed an image thereon is passed between a heat roller and a pressure roller. The heat roller is required to have a high heat capacity in order to obtain an excellent fixing property, namely, to obtain a high toner adhesion property on the transfer medium.

From the viewpoint of preventing warming of a global environment in recent years, there is an increasing demand for energy saving with respect to an electrophotographic image forming apparatus. Therefore, in an image forming apparatus employing a heat roller fixing system, many investigations have been made for achieving a low-temperature fixing toner in order to reduce the amount of heat required for fixing.

A most representative toner aiming at the low-temperature fixing is a toner using a crystalline resin.

For example, it was proposed a toner containing a crystalline polyester resin as a threadlike crystalline structure. This toner enabled to achieve a sharp-melting property of the crystalline polyester resin and improved low-temperature fixing (Patent document 1: JP-A No. 2013-257415).

Further, it was proposed a toner having a crystal line polyester resin finely dispersed as a domain phase of an average size of 300 nm or less in an amorphous resin. This structure was achieved by adjusting a content of a carboxy group in the amorphous resin and a content of an ester group in the crystalline polyester resin (Patent document 2: JP-A. No. 2014-185194).

The crystalline polyester resin in this toner will promote compatibility during the heat fixing. In addition, it has a small degree of crystallization and a small amount of dispersion in the degree of crystallization. As a result, the image formed with this toner will have an improved uniform glossiness.

On the other hand, as coloring agents in yellow toners, there are used pigments such as: C. I. Pigment Yellow 93, C. I. Pigment Yellow 155, C. I. Pigment Yellow 180, C. I. Solvent Yellow 93, and C. I. Solvent Yellow 163 (Patent documents 3 and 4: JP-A Nos. 2000-75552 and 2006-313302).

However, these coloring agents have insufficient coloring power when used alone. In order to obtain a required coloring power, an added amount of the coloring agent has to be increased.

However, when the added amount of the coloring agent is increased, the incorporating capacity of the coloring agent in the toner will be lowered, and there are produced problems that the charging property is decreased and the toner is easily scattered. Some pigments contain an aromatic amine, and they will emit odor of an aromatic amine evaporated during thermal fixing when they are contained with an increased amount (for example, refer to Patent document 5: JP-A No. 2004-109310). In addition, when a toner contains too much amount of pigment, the toner will hardly decrease elasticity by the filler effect. This will deteriorate low-temperature fixability.

When an added amount of a toner to a paper is increased, it may be obtained a required coloring power without increasing an amount of an added pigment. However, this will cause increased cost and easy scattering by an increased added amount toner.

SUMMARY

The present invention was done based on the above-described problems and situations. An object of the present invention is to provide an electrostatic image developing toner excellent in low-temperature fixability and coloring power with suppressed toner scattering.

The present inventors have made investigation to solve the above-described problems, and have achieved the present invention. It was found that the coloring power is increased by using C. I. Pigment Yellow 74 as a pigment even with a reduced amount and the scattering of the toner will be reduced, and that a dispersion property of the crystalline resin in the toner particles is increased to result in obtaining excellent low-temperature fixability by incorporating a specific amount of alkoxy aniline in the toner particles.

Namely, the problems relating to the present invention are solved by the following embodiments.

1. An electrostatic image developing toner comprising toner particles containing: an amorphous resin including an amorphous vinyl resin; and a crystalline resin, wherein the toner particles contain: a coloring agent including C. I. Pigment Yellow 74; and alkoxy aniline with an amount in the range of 0.1 to 50.0 mass ppm in the toner particles.
2. The electrostatic image developing toner described in the embodiment 1, wherein the toner particles further contain at least one selected from the group constituting of C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163 together with C. I. Pigment Yellow 74.
3. The electrostatic image developing toner described in the embodiments 1 or 2, wherein the crystalline resin contains a crystalline polyester resin, and a content of the crystalline polyester resin in the toner particles is in the range of 5 to 30 mass %.
4. The electrostatic image developing toner described in the embodiment 3, wherein the crystalline polyester resin is a hybrid resin composed of a crystalline polyester resin and an amorphous resin.
5. The electrostatic image developing toner described in the embodiments 3 or 4, wherein the crystalline polyester resin has an acid value in the range of 15 to 30 mg KOH/g.
6. The electrostatic image developing toner described in any one of the embodiments 1 to 5, wherein the alkoxy aniline is 2-methoxyaniline.

7. The electrostatic image developing toner described in any one of the embodiments 1 to 6, wherein the toner particles further contain an amorphous polyester resin as the amorphous resin.

By the above-described embodiments, it is possible to provide an electrostatic image developing toner excellent in low-temperature fixability and coloring power with suppressed toner scattering.

A formation mechanism or an action mechanism of the effects of the present invention is not made clear, but it is supposed to be as follows.

It is possible to obtain an excellent coloring power even with a small amount of addition by using C. I. Pigment Yellow 74 as a coloring agent. Since there is no need to increase an amount of the added coloring agent, the incorporating property of the coloring agent was improved, and it is supposed that the scattering of the toner particles was reduced. As a result of decreasing the amount of the added coloring agent, it is supposed that the filler effect was reduced and deterioration of low-temperature fixability was prevented.

Further, when the toner particles incorporate alkoxy aniline in the above-described specific amount, it was possible that the crystalline resin was dispersed uniformly with a small size in the toner particles by adjusting the degree of crystalline to be small. It is supposed that excellent low-temperature fixability was obtained by the crystalline polyester resin.

DESCRIPTION OF THE PREFERRED EMBODIMENTS

An electrostatic image developing toner of the present invention has toner particles containing: an amorphous resin including an amorphous vinyl resin; and a crystalline resin, wherein the toner particles contain: a coloring agent including C. I. Pigment Yellow 74; and alkoxy aniline with an amount in the range of 0.1 to 50.0 mass ppm in the toner particles. This technical feature is common to the inventions relating to the above-described embodiments.

From the viewpoint of obtaining a required color or high coloring power, it is a preferable embodiment of the present invention that the toner has toner particles further containing at least one selected from the group constituting of C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163 together with C. I. Pigment Yellow 74.

Further, from the viewpoint of obtaining more excellent low-temperature fixability, it is preferable that the crystalline resin contains a crystalline polyester resin, and a content of the crystalline polyester resin in the toner particles is in the range of 5 to 30 mass %.

From the viewpoint of increasing the dispersing property of the crystalline polyester resin in the amorphous resin and obtaining excellent low-temperature fixability, it is preferable that the crystalline polyester resin is a hybrid resin composed of a crystalline polyester resin and an amorphous resin.

From the viewpoint of further increasing the dispersing property of the crystalline polyester resin, it is preferable that the crystalline polyester resin has an acid value in the range of 15 to 30 mg KOH/g.

From the viewpoint of increasing the dispersion property of the crystalline resin and preventing the amorphous resin from plasticizing, it is preferable that the toner particles contain 2-methoxyaniline as the alkoxy aniline.

The toner particles of the present invention may contain an amorphous polyester resin as the amorphous resin.

The present invention and the constitution elements thereof, as well as the embodiments to carry out the present invention, will be detailed in the following. In the present description, when two figures are used to indicate a range of value before and after "to", these figures themselves are included in the range as a lowest limit value and an upper limit value.

[Electrostatic Image Developing Toner]

An electrostatic image developing toner of the present invention has toner particles containing as binder resins: an amorphous resin including an amorphous vinyl resin; and a crystalline resin.

From the viewpoint of achieving both heat-resisting storage stability and low-temperature fixability, it is preferable that the toner particles have a domain-matrix structure formed with a matrix phase of an amorphous resin excellent in heat-resisting property and a domain phase of crystalline resin dispersed in the matrix phase. A domain-matrix structure designates a structure in which there exists a domain phase having a closed boundary face (interface between two phases) in a continuous matrix phase.

In the present invention, the toner particles have: a coloring agent including C. I. Pigment Yellow 74; and alkoxy aniline with an amount in the range of 0.1 to 50.0 mass ppm in the toner particles.

[Amorphous Resin]

An amorphous resin of the present invention is used as one of binder resins. Any resin exhibiting an amorphous property may be used without limitation among known amorphous resins. Here, an amorphous property designates a property that indicates a glass transition point (Tg) in an endothermic curve obtained by measurement with differential scanning calorimetry (DSC), but does not indicate a clear endothermic peak of a melting point during the temperature rising step. Here, "a clear endothermic peak" designates an endothermic peak having a half bandwidth within 15° C. in an endothermic curve obtained under the condition of a temperature raising rate of 10° C./min.

[Amorphous Vinyl Resin]

From the viewpoint of obtaining a toner excellent in plastic property during thermal fixing process, it is preferable that the toner particles incorporate an amorphous vinyl resin as the amorphous resin. The amorphous vinyl resin is also preferable in view of the solubility of the alkoxy aniline.

An amorphous vinyl resin designates an amorphous polymer among polymers produced with a monomer having a vinyl group (hereafter, it is called as a vinyl monomer).

Usable amorphous vinyl resins in the present invention are: styrene-acrylic resins, styrene resins, and acrylic resins. Among them, styrene-acrylic resins are preferably used since they are excellent in heat-resisting property.

As vinyl monomers to form an amorphous vinyl polymer, the following may be used. The vinyl monomers may be used alone, or may be used in combination of two or more kinds.

(1) Styrene Monomers

Styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers (2) (Meth)acrylic Acid Ester Monomers Methyl (meth)acrylate, ethyl (meth)acrylate, n-butyl (meth)acrylate, iso-propyl (meth)acrylate, iso-butyl (meth)

acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate and dimethylaminoethyl (meth)acrylate, and derivatives of these monomers (3) Vinyl Esters Vinyl propionate, vinyl acetate, and vinyl benzoate (4) Vinyl Ethers Vinyl methyl ether and vinyl ethyl ether (5) Vinyl Ketones Vinyl methyl ketone, vinyl ethyl ketone and vinyl hexyl ketone (6) N-Vinyl Compounds N-vinyl carbazole, N-vinyl indole, and N-vinyl pyrrolidone (7) Others Vinyl compounds such as vinylnaphthalene and vinylpyridine; acrylic acid or methacrylic acid derivatives such as acrylonitrile, methacrylonitrile, and acrylamide It is preferable to use vinyl monomers containing ionic-dissociative group such as a carboxy group, a sulfonic acid group or a phosphoric acid group since they enable to easily adjust affinity with the crystalline resin. Specific examples are as follows.

Examples of a monomer containing a carboxy group are: acrylic acid, methacrylic acid, maleic acid, itaconic acid, cinnamic acid, fumaric acid, monoalkyl maleate, and monoalkyl itaconate.

Examples of a monomer containing a sulfonic acid group are: styrenesulfonic acid, allylsulfosuccinic acid, and 2-acrylamido-2-methylpropanesulfonic acid.

An example of a monomer containing a phosphoric acid group is acid phosphooxyethyl methacrylate.

Further, the amorphous vinyl polymer maybe changed into a cross-linked resin by using poly-functional vinyl compounds as vinyl monomers. Examples of a poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

[Amorphous Polyester Resin]

The toner particles of the present invention may contain an amorphous polyester resin as an amorphous resin, in addition to the above-described amorphous vinyl resin.

An amorphous polyester resin is a resin exhibiting an amorphous property among polyester resins produced by polymerization reaction with a carboxylic acid having two or more valence (polycarboxylic acid) and an alcohol having two or more valence (polyhydric alcohol). An amorphous polyester resin maybe prepared by polymerization (esterification) of the polycarboxylic acid monomer and the polyhydric alcohol monomer with a known esterification catalyst.

A polycarboxylic acid monomer is a compound containing two or more carboxy groups in one molecule.

Examples of a polyvcarboxylic acid monomer for producing an amorphous polyester resin are: phthalic acid, isophthalic acid, terephthalic acid, trimellitic acid, naphthalene-2,6-dicarboxylic acid, malonic acid, mesaconic acid, dimethyl isophthalate, fumaric acid, and dodecenylsuccinic acid. Among these, dimethyl isophthalate, terephthalic acid, dodecenylsuccinic acid, and trimellitic acid are preferred.

A polyhydric alcohol monomer is a compound containing two or more hydroxy groups in one molecule.

Examples of a polyhydric alcohol monomer for producing an amorphous polyester resin are as follows. Examples of an alcohol having two or three valence are: ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexane dimethanol, dipropylene glycol, polyethylene glycol, polypropylene glycol, ethylene oxide adduct of bisphenol A (BPA-EO), propylene oxide adduct of bisphenol A (BPA-PO), glycerin, sorbitol, 1,4-sorbitan, and trimethylolpropane. Among them, preferable are: ethylene oxide adduct of bisphenol A and propylene oxide adduct of bisphenol A (BPA-PO).

Usable esterification catalysts for producing an amorphous polyester resin of the present invention are: alkali metal compounds made of sodium and lithium; alkali earth metal compounds made of magnesium and calcium; metal compounds made of metals such as aluminum, zinc, manganese, antimony, titanium, tin, zirconium, and germanium; phosphorous acid compounds, phosphoric acid compounds, and amine compounds.

The polymerization temperature is not limited in particular. A preferable polymerization temperature is in the range of 150 to 250° C. The polymerization time is not limited in particular. A preferable polymerization time is in the range of 0.5 to 10 hours. The inside pressure of the reaction system may be reduced when needed.

A glass transition point of the amorphous resin is preferably in the range of 25 to 60° C., more preferably in the range of 35 to 55° C. from the viewpoint of sufficiently achieving both low-temperature fixability and heat-resisting storage stability.

A glass transition point (Tg) may be measured by using a differential scanning calorimeter such as "Diamond DSC" (PerkinElmer Inc.), for example. Specific measurement is done as follows.

First, 3.0 mg of measuring sample is sealed in an aluminum pan and the temperature is changed in the order of heating-cooling-heating. In the first heating step, the temperature is increased from room temperature (25° C.), and in the second heating step, the temperature is increased from 0° C. In both heating steps, the temperature is raised to 200° C. at a heating rate of 10° C./min, then the temperature is kept at 200° C. for 5 minutes. In the cooling step, the temperature is decreased from 200° C. to 0° C. at a cooling rate of 10° C./min. Then the temperature is kept at 0° C. for 5 minutes. A shift of a base line in the measurement curve obtained in the second heating step is observed. A cross point of an extended line of a base line before shifted and a tangential line indicating a maximum slope in the shift portion of the base line is determined as a glass transition point (Tg). An empty aluminum pan is used for a reference.

A weight average molecular weight (Mw) of the amorphous resin may be in the range of 10,000 to 100,000.

A weight average molecular weight (Mw) and a number average molecular weight (Mn) of a resin maybe determined from the molecular weight distribution obtained by gel permeation chromatography (GPC) as indicted in the following.

A measuring sample is dissolved in tetrahydrofuran to a concentration of 1 mg/mL by a treatment with an ultrasonic disperser at a temperature of 40° C. for 15 minutes. The solution is then treated with a membrane filter having a pore size of 0.2 μm to obtain a sample solution.

A GPC device "HLC-8120 GPC" (TOSOH Corp.) and a column set "TSK guard column+3×TSK gel Super HZM-M" (TOSOH Corp.) are used. The column temperature is held at 40° C., and tetrahydrofuran (THF) is supplied at a flow rate of 0.2 mL/min as a carrier solvent. An aliquot (10 μL) of the sample solution is injected into the device along with the carrier solvent and the sample is detected by means of a refractive index (RI) detector. The molecular weight distribution of the sample is calculated by using a calibration curve, which is determined by using standard monodisperse polystyrene particles (made by Pressure Chemical Co. Ltd.). The calibration curve is prepared by using 10 kinds of polystyrene particles (made by Pressure Chemical Co. Ltd.) each having a molecular weight of: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

When an acid value of the amorphous resin is made smaller than an acid value of the crystalline polyester resin, alkoxy aniline will easily enclose the crystalline polyester resin, and the dispersing property of the crystalline polyester resin will be sufficiently increased. This is a preferable embodiment.

An acid value of an amorphous resin may be measured based on the method described in JIS K0070-1992 (potentiometric titration). In the present measurement., a used solvent is a mixture of tetrahydrofuran and isopropyl alcohol having a volume ratio of 1:1.

[Crystalline Resin]

A crystalline resin is used as a binder resin of the present invention. A known crystalline resin may be used without any limitation as long as it exhibits a crystalline property. Here, when a resin exhibits a crystalline property, it means that the resin has a clear endothermic peak of melting point in an endothermic curve obtained by DSC during the temperature increasing step. Here, "a clear endothermic peak" designates a peak having a half bandwidth within 15° C. in an endothermic curve under the condition of a temperature raising rate of 10° C./min.

From the viewpoint of obtaining a low-temperature fixability, the toner particles preferably contain a crystalline polyester resin as a crystalline resin. In addition, a content of the crystalline polyester resin in the toner particles is preferably in the range of 5 to 30 mass %.

When the content of the crystalline polyester resin in the toner particles is 5 mass % or more, a sufficient low-temperature fixability may be obtained, and when the content of the crystalline polyester resin in the toner particles is 30 mass % or less, it may be prevented toner scattering due to lowering of the charging property.

[Crystalline Polyester Resin]

A crystalline polyester resin is a resin exhibiting crystalline property among polyester resins prepared by polymerization of a monomer of carboxylic acid having two or more valence (polycarboxylic acid) and a monomer of alcohol having two or more valence (polyhydric alcohol).

The crystalline polyester resin may be formed in the same way as preparation of the above-described amorphous polyester resin.

Examples of a polycarboxylic acid monomer usable for preparation of the crystalline polyester resin are: saturated aliphatic dicarboxylic acids such as oxalic acid, malonic acid, succinic acid, adipic acid, sebacic acid, azelaic acid, n-dodecyl succinic acid, 1,10-decane dicarboxylic acid (dodecanedioic acid), and 1,12-dodecane dicarboxylic acid (tetradecanedioic acid); alicyclic dicarboxylic acid such as cyclohexane dicarboxylic acid; aromatic dicarboxylic acids such as phthalic acid, isophthalic acid, and terephthalic acid; and polycarboxylic acids having three valence or more such as trimellitic acid, and pyromellitic acid. Further, there may be cited acid anhydrides and alkyl esters of 1 to 3 carbon atoms of these carboxylic acid compounds. These may be used alone, or they may be used in combination of two or more kinds.

Examples of a polyhydric alcohol monomer usable for preparation of the crystalline polyester resin are: aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; polyhydric alcohols having three or more valence such as glycerin, pentaerythritol, trimethylol propane and sorbitol. These may be used alone, or they maybe used in combination of two or more kinds.

(Hybrid Resin)

A crystalline polyester resin used in the present invention is preferably a hybrid resin composed of a crystalline polyester resin and an amorphous resin. This kind of hybrid resin can adjust affinity with the amorphous resin so that the crystalline resin will be uniformly dispersed with a small size in the amorphous resin.

In the above-described hybrid resin, a resin portion having a structure derived from the crystalline polyester resin is called as a crystalline polyester resin segment, and a resin portion having a structure derived from the amorphous resin is called as an amorphous resin segment.

The amorphous resin segment in the hybrid crystalline resin has high affinity with the amorphous resin used as a matrix phase. As a result, a molecular chain of the crystalline resin segment will be easily arrayed, and it may be obtained a sufficient crystalline property.

A content of the crystalline polyester resin segment in the hybrid resin is preferably in the range of 50 to 98 mass % from the viewpoint of giving a sufficient crystalline property to the hybrid resin.

The constituting components and the content of each segment such as crystalline polyester resin segment in the hybrid resin may be determined, for example, by NMR analysis or by methylation reaction Pyrolysis Gas Chromatography with Mass Spectrometry (Py-GC/MS).

The amorphous resin segment is not limited in particular as long as it exhibits an amorphous property. It maybe cited: amorphous polyester resin segment, amorphous vinyl resin segment, amorphous urethane resin segment, and amorphous urea resin segment. Among them, when an amorphous resin segment contains a derivative of an amorphous polyester resin used as a binder resin, it may be increased compatibility with the amorphous resin in the matrix phase. Consequently, a uniform charging property may be obtained.

A content of the amorphous resin segment in the hybrid resin is in the range of 40 to 60 mass o, more preferably in the range of 45 to 50 mass %.

As a preparation method of the above-described hybrid resin, it maybe cited, for example, the following preparation methods (1) to (3).

(1) A method having the following steps of: reacting a bireactive monomer with a crystalline polyester resin prepared beforehand; then, reacting a raw material monomer used for producing an amorphous resin to result in forming a chemical bond between the crystalline polyester resin segment and the amorphous resin segment.

(2) A method having the following steps of: reacting a bireactive monomer with an amorphous polyester resin prepared beforehand; then, reacting a polycarboxylic acid monomer and a polyhydric alcohol monomer, both being raw materials for producing a crystalline polyester resin, to result in forming a chemical bond between the amorphous resin segment and the crystalline polyester resin segment.

(3) A method having the following steps of: respectively forming a crystalline polyester resin and an amorphous resin beforehand; then, bonding these two substances with a bireactive monomer to form a hybrid resin having two segments.

Among these, the preparation method (2) is preferable since the preparation is easy. For example, there are mixed: a vinyl monomer that is a raw material for an amorphous vinyl resin; a polycarboxylic acid and a polyhydric alcohol both being raw materials for a crystalline polyester resin; and a bireactive monomer. Then, a polymerization initiator is added to make addition polymerization of the vinyl monomer with the bireactive monomer to result in forming an amorphous vinyl resin segment. Thereafter, an esterification catalyst is added to make polycondensation reaction. Thus, a crystalline polyester resin segment is formed.

A bireactive monomer is a monomer enabling to bind a crystalline polyester resin and an amorphous resin. It is a monomer containing a substituent capable of reacting with a crystalline polyester resin such as a hydroxy group, a carboxy group, an epoxy group, a primary amino group, and a secondary amino group; and an ethylenically unsaturated group capable of reacting with an amorphous resin. Among them, preferable is a vinyl carboxylic acid having a hydroxy group or a carboxy group and an ethylenically unsaturated group.

As a bireactive monomer, it may be cited: (meth)acrylic acid, fumaric acid, and maleic acid. It may be used esters of a hydroxyalkyl group (carbon atom number of 1 to 3). From the viewpoint of reactivity, preferable are: acrylic acid, methacrylic acid and fumaric acid.

An added amount of the bireactive monomer is preferably in the range of 1 to 10 mass parts, more preferably in the range of 4 to 8 mass parts with respect to 100 mass parts of the total monomers used for forming the amorphous resin segment from the viewpoint of improving the low-temperature fixability, the hot offset resistivity, and the durability of the toner.

An acid value of the crystalline polyester resin according to the present invention is preferably in the range of 15 to 30 mg KOH/g.

When the acid vale is 15 mg KOH/g or more, the alkoxy aniline will easily enclose the crystalline polyester resin. As a result, it will be increased the dispersing property of the crystalline polyester resin to result in improving the low-temperature fixability.

When the acid vale is 30 mg KOH/g or less, the hydrophilicity will be increased and it may prevent uneven distribution of the crystalline polyester resin on the surface the toner particles. As a result, it maybe prevented decrease of the charging property cause by uneven distribution.

An acid value is an amount of potassium hydroxide (KOH) in mg required to neutralize the carboxy group existing in 1 g of sample. The acid value is measured based on the method described in JIS K0070-1966.

(Preparation of Reagents)

(a) Phenolphthalein Solution 1.0 g of phenolphthalein is dissolved in 90 mL of ethyl alcohol (95 vol %), then ion-exchanged water is added to make a volume of 100 mL. Thus, a phenolphthalein solution is obtained.

(b) Potassium Hydroxide Solution 7.0 g of potassium hydroxide (JIS special grade) is dissolved in 5 mL of ion-exchanged water. Then, ethyl alcohol (95 vol %) is added to make a volume of 1 L. The solution is placed in an alkali resistive container to avoid contact with carbon dioxide. After leaving it for 3 days, the solution is filtered to obtain a potassium hydroxide solution. The standardization is done based on the description in JIS K0070-1966.

(Main Test)

2.0 g of the pulverized sample is accurately weighted and placed in a 200 mL conical flask. Then, 100 mL of mixed solvent of toluene and ethanol (2:1) is added in the conical flask, and the sample is dissolved over a period of 5 hours.

Subsequently, several drops of the phenolphthalein solution are added as an indicator. The solution of the sample is titrated with the potassium hydroxide solution. The end point of the titration is made at the point that the pale red color of the indicator is remained for about 30 seconds.

(Blank Test)

The same titration as described above is done without using the sample (namely, only the mixed solvent of toluene an ethanol (2:1) is used for titration).

An acid value is calculated by substituting the obtained results in the following relation (1).

$$A=[(C-B)\times f\times 5.6]/S \qquad \text{Relation (1)}$$

The characters in the relation mean the following.

A: Acid value (mg KOH/g)

B: Added amount (mL) of potassium hydroxide solution in the blank test.

C: Added amount (mL) of potassium hydroxide solution in the main test.

f: Factor of 0.1 mol/L potassium hydroxide ethanol solution

S: Mass (g) of sample.

The crystalline polyester resin preferably has a weight average molecular weight (Mw) in the range of 5,000 to 50,000, and it preferably has a number average molecular weight (Mn) in the range of 1,500 to 25,000. The weight average molecular weight (Mw) and the number average molecular weight (Mn) of the crystalline polyester resin may be measured with the above-described GPC.

A melting point (Tm) of the crystalline polyester resin is preferably in the range of 55 to 90° C., more preferably in the range of 70 to 85° C. from the viewpoint of obtaining a sufficient low-temperature fixability and hot offset resistance.

The melting point of the crystalline polyester resin may be controlled by the resin composition.

A melting point (Tm) is a peak top temperature in an endothermic curve. It may be measured with DSC.

Specific measurement is done as follows. A measuring sample is sealed in an aluminum pan (KIT NO.B0143013), and the sealed sample is set in a sample holder of a calorimeter "Diamond DSC" (PerkinElmer Inc.). The temperature is changed in the order of heating-cooling-heating. In the first heating step, the temperature is increased from room temperature (25° C.), and in the second heating step, the temperature is increased from 0° C. In both heating steps, the temperature is raised to 150 ° C. at a heating rate of 10° C./min, then the temperature is kept at 150° C. for 5 minutes. In the cooling step, the temperature is decreased from 150° C. to 0° C. at a cooling rate of 10° C./min. Then the temperature is kept at 0° C. for 5 minutes. A shift of a base line in the measurement curve obtained in the second heating is observed. A peak top temperature in an endothermic curve obtained in the second heating step is measured as a melting point.

[Coloring Agent]

In the present invention, the toner particles contain at least a coloring agent of C. I. Pigment Yellow 74. By using C. I. Pigment Yellow 74 as a coloring agent, it is possible to produce a yellow toner having a high coloring power with a small added amount. By using this pigment, it is possible to reduce the content of the coloring agent. As a result, the incorporating capacity of the coloring agent in the toner particles will be increased, and toner scattering will be restrained. Further, excellent low-temperature fixability will be obtained through control of a filler effect.

From the viewpoint of obtaining a required hue and high coloring power, it is preferable to use C. I. Pigment Yellow 74 together with at least one pigment selected from the group consisting of: C. I. Pigment Yellow 93, C. I. Pigment. Yellow 155, C. I. Pigment Yellow 180, C. I. Pigment Yellow 185, C. I. Solvent Yellow 93 and C. I. Solvent Yellow 163.

A content of the co-used pigment is preferably in the range of 5 to 30 mass %, more preferably, in the range of 5 to 10 mass % with respect to 100 mass % of C. I. Pigment Yellow 74 from the viewpoint of obtaining high coloring power and preventing decreased charging property.

A known dye and organic pigment may be combined to use as a coloring agent other than the above-described yellow pigments.

Any dye and organic pigment may be used as coloring agents Examples of an organic pigment are: C. I. Pigment Reds 5, 48:1, 53:1, 57:1, 81:4, 122, 139, 144, 149, 166, 177, 178, 222, 238, and 269; C. I. Pigment Yellows 14, 17, 94, and 138; C. I. Pigment Oranges 31 and 43; and C. I. Pigment Blues 15:3, 60, and 76. Examples of a dye are: C. I. Solvent Reds 1, 49, 52, 58, 68, 11, and 122; C. I. Solvent Yellows 19, 44, 77, 79, 81, 82, 98, 103, 104, 112, and 162; and C. I. Solvent Blues 25, 36, 69, 70, 93, and. 95.

A content of the coloring agent is preferably in the range of 1 to 20 mass parts, more preferably, in the range of 2 to 15 mass parts with respect to 100 mass parts of the binder resin.

[Alkoxy Aniline]

A content of alkoxy aniline in the toner particles according to the present invention is in the range of 0.1 to 50.0 mass ppm. The alkoxy aniline that carries a positive electric charge will enclose the crystalline resin having a negative electric charge. Consequently, the same components of the crystalline resin are hardly gathered together. As a result, it is possible to uniformly disperse the crystalline resin with a small size in the toner particles. By the improved dispersion property of the crystalline resin, it is possible to make a degree of crystallization of the crystalline resin to be small. Hence, it is possible to obtain an excellent low-temperature fixability produced by the crystalline resin.

When the content of alkoxy aniline is 0. 1 mass ppm or more, it may be obtained a toner having improved low-temperature fixability. When the content is 50.0 mass ppm or less, an amount of the positive electric charge in the toner particles may be controlled to prevent lowering of toner charging power. Thus, the toner scattering due to lowered toner charging power may be restrained.

The content of alkoxy aniline in the toner particles may be adjusted by adding alkoxy aniline.

The above-described C. I. Pigment. Yellow 74 may originally contain alkoxy aniline. In this case, the content of alkoxy aniline in the pigment is specified beforehand. Then, the content of alkoxy aniline in the toner particles may be adjusted to be in the range of 0.1 to 50.0 mass ppm by making pre-treatment such as heating or vacuum degassing to the pigment.

The above-described alkoxy aniline may have an alkoxy group containing a straight or branched chain alkyl portion. From the viewpoint of restraining plasticizing of the amorphous resin, it is preferable that the alkyl portion has a carbon atom number in the range of 1 to 6. It can restrain lowering of the charging property and fluidity of the toner caused by plasticization of the amorphous resin.

From the viewpoint of increasing the dispersing property of the crystalline resin and restraining plasticizing of the amorphous resin, it is preferable that the toner particles contain 2-methoxyaniline as alkoxy aniline.

Further, two or more kinds of alkoxy anilines may be co-used.

A content of alkoxy aniline in the toner particles may be measured with the following method. A content of alkoxy aniline originally contained in C. Pigment Yellow 74may also be measured in the same manner.

(Measuring Method of Alkoxy Aniline)

5 mg of toner sample is placed in a container (160 mL of volume) of an out gas collecting apparatus HM-04 (made by Japan Analytical Industry Co. Ltd.). Under a nitrogen gas flow at a flow rate of 200 mL/min, the temperature is raised from room temperature to 120° C. over a period of 10 min. The sample is kept at 120° C. for 50 min. The out gas emitted from the sample is collected with a heat-desorption collecting tube (AERO TDGL-Tube, made by GL Science Co. Ltd.) loaded with Tenax-GR as a primary adsorbing tube. Then, by using a heat-desorption apparatus JTD 505 (made by Japan Analytical Industry Co. Ltd.), the primary adsorbing tube is heated to 250° C. to collect the adsorbed gas to the primary adsorbing tube is collected by condensing to the secondary adsorbing tube cooled at −40° C.

A gas chromatography mass spectrometer GCMS-QP2010 (made by Shimadzu Co. Ltd.) is used for the measurement. The secondary adsorbing tube having collected the gas is hated to 280° C. with a Curie point method to carry out qualitative and quantitative analysis from MS (mass) and the peak area. A quantitative analysis of alkoxy aniline is done based on the calibration curve prepared beforehand from the mass and the peak area.

As a GC/MS column, it is used HP-1 MS (made by Agilent Technology Co. Ltd.) (length of 60 m, film pressure of 0.25 μm, and inner diameter of 0.25 mm). The temperature conditions of the column are as follows: it is kept at 40° C. for 4 min, then it is raised to 140° C. at a rate of 5° C./min, then it is raised to 240° C. at a rate of 10° C./min, then further it is raised to 290° C. at a rate of 25° C./min, and it is kept at 290° C. for 3 min.

The toner particles of the present invention may contain a releasing agent, a charge controlling agent, and an external additive when needed.

[Releasing Agent]

A releasing agent used in the present invention is not limited in particular. A variety of known waxes may be used. Examples of usable wax are: polyolefin waxes such as polyethylene wax and polypropylene wax; branched chain hydrocarbon wax such as microcrystalline wax; long chain hydrocarbon waxes such as paraffin wax and Sasol wax; dialkyl ketone wax such as distearyl ketone; ester waxes such as carnauba wax, montan wax, behenyl behenate, trimethylolpropane tribehenate, pentaerythritol tetrabehenate, pentaerythritol diacetate dibehenate, glycerin tribehenate, 1,18-octadecanediol distearate, tristeary trimellitate, and distearyl maleate; and amide waxes such as ethylenediamine behenyl behenate and tristearyamide trimellitate.

A content of the releasing agent in the toner particles is usually in the range of 1 to 30 mass % with respect to 100 mass parts of the binder resin. More preferably, it is in the range of 5 to 20 mass %. By making the content of the releasing agent in the above-described range, it may be obtained sufficient fixing-separation property.

A content of the releasing agent in the toner particles is preferably in the range of 3 to 15 mass %.

[Charge Controlling Agent]

As a charge con rolling agent, it may be used the following known compounds. Examples thereof are: Nigrosine dyes, metal salts of naphthenic acid, metal salts of higher fatty acids, alkoxy amines, quaternary ammonium salts, azo type metal complexes, and salicylic acidmetal salts. By adding a charge controlling agent, it can obtain a toner excellent in charge controlling property.

A content of the charge controlling agent in the toner is preferably in the range of 0.1 to 5.0 mass parts with respect to 100 mass parts of the binder resin in the toner.

[External Additive]

The toner particles of the present invention may be directly used for the toner. However, in order to improve fluidity, charging property, and cleaning property of the toner, it may be added an external additive such as a fluidity increasing agent and a cleaning assisting agent.

Examples of an external additive are: inorganic oxide fine particles such as silica fine particles, alumina fine particles, and titanium oxide fine particles; inorganic stearic acid compound fine particles such as aluminum stearate fine particles and zinc stearate fine particles; and inorganic titanium acid compound fine particles such as strontium titanate fine particles and zinc titanate fine particles. These may be used alone, or they may be used in combination of two or more kinds.

From the viewpoint of improving heat-resisting storage stability and environmental stability, these external additives may be subjected to a surface glossing treatment by using a silane coupling agent, a titan coupling agent, a higher aliphatic acid, or a silicone oil.

An added amount of the external additive (the total amount of the external additives when a plurality of external additives are used) is preferably in the rage of 0.05 to 5 mass parts with respect to 100 mass parts of toner particles. More preferably, it is in the rage of 0.1 to 3 mass parts.

[Core-Shell Structure]

The toner particles may be used without modification. However, they may have a multi-layered structure such as a core-shell structure (a morphology in which a shell layer is formed on the surface of the toner particles used as a core particle).

Here, the core-shell structure is not limited to a structure in which the shell layer completely covers the core particle. It includes a structure in which a part of the core particle is exposed.

The cross-sectional structure of the core-shell structure may be observed and confirmed with a known method such as a transmission electron microscope (TEM) or a scanning probe microscope (SPM).

In the case of the core-shell structure, the core particle and the shell layer each may have different glass transition point, melting point, and hardness. As a result, it is possible to make a toner design corresponding to the purpose. For example, a shell layer may be formed by aggregated and fused a resin having a high glass transition point (Tg) on the surface of a core particle containing a binder resin, a coloring agent and a releasing agent, and having a low glass transition point (Tg). Preferably, the shell layer contains an amorphous resin.

[Average Particle Size of Toner Particles]

It is preferable that the toner particles of the present invention have an average particle size of, for example, 3 to 10 μm, more preferably 5 to 8 μm in volume-based median diameter ($d_{50}$). When the volume-based median diameter ($d_{50}$) is within the above-described range, the minute dot image of 1200 dpi level may be faithfully reproduced.

The average particle size of the toner particles may be controlled by changing the concentration of the coagulant agent, the added amount of organic solvent, fusing time, the composition of the binder resin used in the production.

The volume-based median diameter ($d_{50}$) of the toner is measured and calculated by using measuring equipment composed of a "MULTISIZER 3" (Beckman Coulter Inc.) and a computer system installed with data processing software "Software V3.51" connected thereto. Specifically, a predetermined amount of a measuring sample (toner) is added to a predetermined amount of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion. The toner dispersion thus prepared is added to "ISOTON II" (Beckman Coulter Inc.) in a beaker placed in sample stand by a pipet until the concentration displayed on the measuring equipment reaches 8%. Within this concentration range, reproducible measurement values may be obtained. The measuring particle count and the aperture size of the measuring equipment are set to 25,000 and 100 μm respectively. The measuring range, which is from 2 to 60 μm, is divided into 256 sections to calculate the respective frequencies. The particle size where the accumulated volume counted from the largest size reaches 50% is determined as the volume-based median diameter ($d_{50}$).

[Average Circularity of Toner Particles]

It is preferable that the toner particles in the toner of the present invention have an average circularity of 0.930 to 1.000, more preferably 0.950 to 0.995 in terms of the stability of the charging characteristics and increasing the low-temperature fixability.

When the average circularity is within the above-described range, the individual toner particles are less crushable. This prevents the triboelectric charge applying member from smudges and it stabilizes the charging characteristics of the toners. Further, high quality images may be formed.

In the present invention, the average circularity of the toner particles may be obtained by measurement with an "FPIA-2100" (Sysmex Corp.).

Specifically, a measuring sample (toner particles) is mixed with an aqueous solution containing a surfactant and is further dispersed by ultrasonic treatment for 1 minute. Thereafter, photographs are taken by means of the "FPIA-2100" (Sysmex Corp.) in the conditions of the HPF (high power imaging) mode at an adequate concentration corresponding to an HPF detect number of 3,000 to 10,000. The average circularity of the toner is calculated by determining the circularity of each toner particle according to the following Relation (I) and dividing the sum of the circularities of the individual toners by the total number of toner particles.

Circularity of toner particle=(Circumference of circle having same area as projected image of particle)/(Perimeter of projected image of particle) Relation (I)

[Developer]

The electrostatic image developing toner of the present invention may be used as a magnetic or non-magnetic single-component toner, or it maybe used as a double-component developer by mixing with a carrier. When the toner of the present invention is used as a double-component developer, as a carrier constituting the double-component developer, there may be utilized magnetic particles composed of materials conventionally known in the art including metals such as iron, ferrite, and magnetite, or alloys of these metals with aluminum or lead. Specifically, ferrite particles are preferable.

As a carrier, there may be utilized a coated carrier prepared by coating the magnetic particles with a resin, or a resin dispersion type carrier prepared by dispersing magnetic particles in a resin.

The volume-based median diameter ($d_{50}$) of the carrier is preferably 20 to 100 μm, it is more preferably 25 to 80 μm. It is possible to determine the volume-based median diameter ($d_5$) of the carrier by using laser diffraction system particle size distribution meter "HELOS" (produced by SYMPATEC Co.) provided with a wet type dispersing apparatus.

[Production Method of Electrostatic Image Developing Toner]

As production methods of an electrostatic image developing toner according to the present invention, it may be cited: a suspension polymerization method, an emulsion aggregation method, and other method. Among them, it is preferable to use an emulsion aggregation method. By using this emulsion aggregation method, it may easily achieve a toner having toner particles of a small size in view of the production cost and the production stability.

The production method of toner particles by the emulsion aggregation method includes the following steps: mixing an aqueous dispersion liquid of amorphous resin particles, an aqueous dispersion liquid of crystalline resin particles, and an aqueous dispersion liquid of coloring agent particles; then aggregating the amorphous resin particles, the crystalline polyester resin particles, and the coloring agent particles, to form toner particles.

An example of a preparation method of a toner by an emulsion aggregation method is described in the following.

Step (1)

In this step (1), an aqueous dispersion liquid of amorphous vinyl resin particles is prepared as a dispersion liquid of an amorphous resin.

For the preparation of an aqueous dispersion liquid of amorphous vinyl resin particles, it may be used a mini-emulsion polymerization method. An example is as follows. A vinyl monomer and a water-soluble radical polymerization initiator are added in an aqueous medium containing a surfactant. Mechanical energy is given to the mixture to form liquid droplets. By using radicals produced from the radical polymerization initiator, a polymerization reaction is proceeded in the liquid droplets. Here, it may be added an oil-soluble polymerization initiator in the liquid droplets.

Here, an aqueous dispersion liquid designates a liquid in which particles are dispersed in an aqueous medium. An aqueous medium is a substance containing water in an amount of 50 mass % or more as a main component.

It may be cited water soluble organic solvents as other components than water. Examples of a water soluble organic solvent are: methanol, ethanol, isopropanol, butanol, acetone, methyl ethyl ketone, and tetrahydrofuran. Among them, alcohol solvents such as methanol, ethanol, and isopropanol are preferable since they don't dissolve the resin.

An amount of the used aqueous medium is usually in the range of 50 to 2,000 mass parts with respect to 100 mass parts of oil phase liquid, more preferably, it is in the range of 100 to 1,000 mass parts.

The aqueous medium may contain a surfactant for the purpose of improving dispersion stability of the oil droplets.

(Surfactant)

As a surfactant it may be used the following known compounds: cationic surfactants such as dodecyl ammonium bromide and dodecyl trimethyl ammonium bromide; anionic surfactants such as dodecyl polyoxyethylene ether, hexadecyl polyoxyethylene ether, nonylphenyl polyoxyethylene ether, lauryl polyoxyethylene ether, and sorbitan monooleate polyoxyethylene ether; and nonionic surfactants such as sodium stearate, sodium laurate, sodium lauryl sulfate, sodium dodecyl benzene sulfonate, and sodium dodecyl sulfate.

The amorphous vinyl resin particles may have a multi-layered structure having two or more layers each having a different composition. The dispersion liquid of the amorphous vinyl resin particles having a multi-layered structure may be prepared with a multi-step polymerization reaction. For example, the dispersion liquid of the amorphous vinyl resin particles having a two-layered structure is prepared as follows. A vinyl monomer is polymerized (first step polymerization) to produce a dispersion liquid of an amorphous vinyl resin particles. Then, a polymerization initiator and a vinyl monomer are added and they are polymerized (second step polymerization) to obtain a target dispersion liquid.

(Polymerization Initiator)

As a polymerization initiator used in this step, any polymerization initiators known in the art maybe suitably used. Specific examples of the polymerization initiator include: persulfates (such as potassium persulfate and ammonium persulfate), azo compounds (4,4'-azobis-4-cyanovaleric acid and its salt, and 2,2'-azobis(2-amidinopropane) salt), peroxide compounds and azobisisobutyronitrile.

(Chain Transfer Agent)

In this step, generally known chain transfer agents may be used for the purpose of adjusting the molecular weight of the amorphous vinyl resin. The chain transfer agents are not limited in particular. Examples thereof include: 2-chloroethanol; mercaptans such as octyl mercaptan, dodecyl mercaptan, t-dodecyl mercaptan, and n-octyl-3-mercaptopropionate; and a styrene dimer.

When toner particles containing additives such as a releasing agent and a charge controlling agent are produced, the additives may be introduced in the toner particles by dissolving or dispersing the additives beforehand in the solution of the vinyl monomer.

Preferably, the additives are dispersed beforehand with the amorphous vinyl resin particles. However, the additives may be introduced in the toner particles by separately preparing a dispersion liquid of additive particles from the amorphous vinyl resin particles, and then aggregating the additive particles with the amorphous vinyl resin particles and coloring agent particles.

An average particle size of the amorphous vinyl resin particles is preferably in the range of 100 to 400 nm in a volume-based median diameter ($d_{50}$). The volume-based median diameter ($d_{50}$) of the amorphous vinyl resin particles may be measured with "Microtrac UPA-150" (made by Nikkiso Co., Ltd.).

When an amorphous polyester resin is used other than an amorphous vinyl resin as an amorphous resin, an aqueous dispersion liquid of the amorphous polyester resin particles is prepared.

Specifically, an amorphous polyester resin is prepared, then, this resin is dissolved or dispersed in an organic solvent to form an oil phase. The produced oil phase is phase-transfer emulsified to disperse amorphous polyester resin particles in an aqueous medium. After controlling the particle size of the oil droplets to achieve a required particle size, the organic solvent is removed. Thus an aqueous dispersion liquid of amorphous polyester resin particles is prepared.

As an organic solvent used for the preparation of the oil phase liquid, it is preferable that the solvent has a low boiling point and a small solubility in water from the viewpoint of easily removing the solvent after formation of the oil droplets.

Specific examples of a solvent are: methyl acetate, ethyl acetate, methyl ethyl ketone, methyl isobutyl ketone, toluene, and xylene. These may be used alone, or they may be used in combination of two or more kinds.

An amount of the used organic solvent is usually in the range of 1 to 300 mass parts with respect to 100 mass parts of amorphous polyester resin.

The emulsion dispersion of the oil phase liquid may be done by making use of mechanical energy.

Step (2)

In this step (2), an aqueous dispersion liquid of crystalline resin particles is prepared. When a crystalline polyester resin is used for a crystalline resin, the aqueous dispersion liquid of the crystalline resin particles is prepared in the same manner as preparation of the aqueous dispersion liquid of the above-described amorphous polyester resin.

An average particle size of crystalline polyester resin particles is preferably in the range of 100 to 400 nm in a volume-based median diameter ($d_{50}$). The volume-based median diameter ($d_{50}$) of the crystalline polyester resin particles may be measured with "Microtrac UPA-150" (made by Nikkiso Co., Ltd.).

Step (3)

In this step (3), at least C. I. Pigment Yellow 74 is used as a coloring agent, and it is dispersed in an aqueous medium in fine particles to prepare an aqueous dispersion of coloring agent particles. When other pigment is used, the other pigment may be also dispersed in this aqueous dispersion.

When alkoxy aniline is added so that a content of alkoxy aniline in the toner particles becomes in the range of 0.1 to 50.0 mass ppm, the alkoxy aniline may be added to the pigment (C. I. Pigment Yellow 74). Here, when the pigment used as a coloring agent already contains alkoxy aniline, and when it is required to reduce the content of alkoxy aniline to the above-described range, the content may be adjusted by making pre-treatment such as heating or vacuum degassing to the pigment.

The aqueous dispersion liquid of coloring agent particles may be obtained by dispersing a coloring agent into an aqueous medium containing a surface-active agent in an amount of larger than a critical micelle concentration (CMC).

The dispersion of the coloring agent may be done by making use of mechanical energy. A dispersion apparatus is not limited in particular. Preferable examples thereof are: pressurized. dispersing machines such as an ultrasonic dispersing machine, a mechanical homogenizer, a Manton-Gaulin homogenizer, and a pressure type homogenizer; and media type dispersing machines such as a sand grinder, a. Getzman mill., and a diamond fine mill.

It is preferable that the dispersed coloring agent particles in the aqueous dispersion liquid have a volume-based median diameter ($d_{50}$) in the range of 10 to 300 nm, more preferably in the range of 100 to 200 nm, and still more preferably in the range of 100 to 150 nm.

The volume-based median diameter ($d_{50}$) of the crystalline polyester resin particles may be measured with "Microtrac UPA-150" (made by Nikkiso Co., Ltd.).

Step (4)

In this step (4), toner particles are formed by aggregating particles of toner constituting components: amorphous resin particles, crystalline polyester resin particles, coloring agent particles, and other particles of toner components.

Specifically, a coagulant is added to an aqueous dispersion liquid dispersed with the above-described particles in an amount of larger than the critical aggregation concentration. Then, the temperature of the liquid is made to be higher than the glass transition temperature (Tg) of the amorphous resin particles. Thus, the aggregation is done. (Coagulant)

The coagulant used in this step is not limited in particular, but it is preferably selected from metal salts of alkali metal salts and alkali earth metal salts. Such metal salts include, for example, monovalent metal salts such as salts of sodium, potassium and lithium; divalent metal salts of calcium, magnesium, manganese and copper; and trivalent metal salts of iron and aluminum. Specific examples of such metal salts include sodium chloride, potassium chloride, lithium chloride, calcium chloride, magnesium chloride, zinc chloride, copper sulfate, magnesium sulfate, and manganese sulfate. Among them, divalent metal salts are particularly preferred since the aggregation is caused by a smaller amount. These coagulants maybe used alone, or they may be used in combination of two or more kinds.

Step (5)

In this step (5), toner particles formed by the step (4) are aged to change the shape of the toner particles into a required shape. This step (5) is done according to necessity.

Specifically, the dispersion liquid of the toner particles formed by the step (4) is heated with stirring. The heating temperature, stirring speed and heating time are controlled so that the average circularity of the aggregated particles reaches a desired level.

Step (4B)

In this step (4B), the toner particles obtained in the step (4) or the step (5) are used as core particles. A shell layer is formed on the core particle so that at least a part of the surface of the core particle is covered. The step (4B) is done only when toner particles having a core-shell structure are produced.

When toner particles having a core-shell structure are produced, they may be produced by the following method. A resin that constitutes a shell layer is dispersed in an aqueous medium to prepare a dispersion liquid of resin particles for a shell layer. This dispersion liquid for a shell layer is added to the dispersion liquid of the toner particles obtained in the step (4) or the step (5). The resin particles for a shell layer are aggregated and fused on the surface of the toner particles. By this, it may be obtained a dispersion liquid of toner particles having a core-shell structure.

For the purpose of more strongly aggregating and fusing the resin particles for a shell layer on the core particles, a heating treatment may be done after the shell forming step. The heating treatment maybe done until the moment of obtaining toner particles reaching a required circularity.

Step (6)

In this step (6), the dispersion liquid of toner particles is cooled. As a condition of cooling treatment, it is preferable to cool the dispersion liquid at a cooling rate of 1 to 20° C./min. A specific cooling method is not limited in particular. It may be cited: a cooling method of introducing a coolant from the outside of the reaction vessel; and a cooling method of directly introducing water into a reaction system.

Step (7)

In this step (7), the toner particles are separated from the cooled dispersion liquid of toner particles through a solid-liquid separation method. The adhered materials such as a surfactant and a coagulant on the obtained toner cake (an assembled body having a shape of a cake made of wet toner particles) are removed and washed out.

A solid-liquid separation method is not limited in particular. It may be used: a centrifugation method, a reduced filtration method using an apparatus such as a Buchner funnel, a filtration method using an apparatus such as a filter press. For washing, it is preferable to wash the toner cake with water until the condition of achieving the electric conductivity of the filtrate to be 10 μS/cm.

Step (8)

In this step (8), the washed toner cake is dried.

Specific examples of a dryer used for drying the toner cake are: a spray drier, a vacuum freeze dryer, and a vacuum dryer. It is preferable to use an apparatus such as a static shelf dryer, a mobile shelf dryer, a fluidized bed dryer, rotary dryer, and a stirring dryer.

A content of water in the dried toner particles is preferably 5 mass % or less, more preferably, is is 2 mass % or less.

When the dried toner particles each are aggregated by a weak particle attraction, the aggregate may be subjected to a broken treatment. As a breaking apparatus, it may be cited: a mechanical mixing machine such as Jet mill, Henschel mixer, a coffee mill, and a food processor.

Step (9)

In this step (9), an external additive is added to the toner particles. The step (9) is done according to need.

As a mixing apparatus of an external additive, it may be used a mixing apparatus such as a Henschel mixer, a coffee mill, or a food processor.

EXAMPLES

Hereinafter, specific examples of the present invention will be described, but the present invention is not limited thereto. In the present examples, the description of "parts" or "%" is used, it represents "mass parts" or "mass %" unless specific notice is given.

(Synthesis of Crystalline Polyester Resin (1))

Into a 5 L reaction vessel equipped with a stirrer, a temperature sensor, a cooling tube, and a nitrogen introducing device, were added 281 mass parts of tetradecanedioic acid and 206 mass parts of 1,6-hexanediol. The temperature of the reaction mixture was raised to 190° C. over a period of 1 hour. After confirming that the reaction system was uniformly stirred, 0.003 mass % of Ti $(OBu)_4$ was added as a catalyst with respect to 100 mass % of tetradecanedioic acid, then, the temperature of the reaction mixture was raised from 190° C. to 240° C. over a period of 6 hours while removing the produced water. Further, with keeping the temperature at 240° C., the dehydration-condensation reaction was continued to perform polymerization. Thus it was obtained a crystalline polyester resin (1).

The obtained crystalline polyester resin (1) had a number average molecular weight (Mn) of 4,400 and an acid value of 20 mg KOH/g.

A weight average molecular weight (Mw) and a number average molecular weight (Mn) of a resin were determined from the molecular weight distribution obtained by GPC as indicted in the following.

A measuring sample was dissolved in tetrahydrofuran to a concentration of 1 mg/mL by a treatment with an ultrasonic disperser at a temperature of 40° C. for 15 minutes. The solution was then treated with a membrane filter having a pore size of 0.2 μm to obtain a sample solution.

A GPC device "HLC-8120 GPC" (TOSOH Corp.) and a column set "TSK guard column+3 x TSK gel Super HZM-M" (TOSOH Corp.) were used. The column temperature was held at 40° C., and tetrahydrofuran (THF) was supplied at a flow rate of 0.2 mL/min as a carrier solvent. An aliquot (10 μL) of the sample solution was injected into the device along with the carrier solvent and the sample was detected by means of a refractive index (RI) detector. The molecular weight distribution of the sample was calculated by using a calibration curve, which was determined by using standard monodisperse polystyrene particles (made by Pressure Chemical Co. Ltd.). The calibration curve was prepared by using 10 kinds of polystyrene particles (made by Pressure Chemical Co. Ltd.) each having a molecular weight of: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

The acid value was measured based on the following method as described in JIS K0070-1966.

1.0 g of phenolphthalein was dissolved in 90 mL of ethyl alcohol (95 vol %), then ion-exchanged water was added to make a volume of 100 mL. Thus, a phenolphthalein solution was obtained. 7.0 g of potassium hydroxide (JIS special grade) was dissolved in 5 mL of ion-exchanged water. Then, ethyl alcohol (95 vol %) was added to make a volume of 1 L. The solution was placed in an alkali resistive container to avoid contact with carbon dioxide. After leaving it for 3 days, the solution was filtered to obtain a potassium hydroxide solution. The standardization was done based on the description in JIS K0070-1966.

2.0 g of the pulverized sample was accurately weighted and placed in a 200 mL conical flask. Then, 100 mL of mixed solvent of toluene and ethanol (2:1) was added in the conical flask, and the sample was dissolved over a period of 5 hours. Subsequently, several drops of the phenolphthalein solution were added as an indicator. The solution of the sample was titrated with the potassium hydroxide solution as a main test. The end point of the titration was made at the point that the pale red color of the indicator is remained for about 30 seconds.

The same titration as described above was done without using the sample as a blank test (namely, only the mixed solvent of toluene an ethanol (2:1) was used for titration).

An acid value was calculated by substituting the obtained titration results in the following relation (1).

$$A=[(C-B)\times f\times 5.6]/S \qquad \text{Relation (1)}$$

The characters in the relation mean the following.

A: Acid value (mg KOH/g)

B: Added amount (mL) of potassium hydroxide solution in the blank test.

C: Added amount (mL) of potassium hydroxide solution in the main test.

f: Factor of 0.1 mol/L potassium hydroxide ethanol solution

S: Mass (g) of sample.

(Synthesis of Crystalline Polyester Resin (2))

A crystalline polyester resin (2) was obtained in the same manner as preparation of the crystalline polyester resin (1) except that the composition of the raw material monomers was changed to use: 267 mass parts of dodecanedioic acid and 160 mass parts of 1,9-nonanediol. The obtained crystalline polyester resin (2) had a number average molecular weight (Mn) of 7,500.

(Synthesis of Crystalline Polyester Resin (3))

The following raw material monomers (including a bireactive monomer) for producing a styrene-acrylic resin segment, and a radical polymerization initiator were placed in a dropping funnel.

| | |
|---|---|
| Styrene | 34 mass parts |
| n-Butyl acrylate | 12 mass parts |
| Acrylic acid | 2 mass parts |
| Di-t-butyl peroxide (radical polymerization initiator) | 7 mass parts |

The following raw material monomers for producing a crystalline polyester resin segment were placed in a four necked flask equipped with a temperature sensor, a dehydration tube, a nitrogen introducing device, a stirrer, and a thermocouple. The mixture was heated to 170° C. to dissolve the content.

| | |
|---|---|
| Tetradecanedioic acid | 271 mass parts |
| 1, 6-Hexanediol | 118 mass parts |

Subsequently, while stirring the content of the flask, the raw material monomers for the styrene-acrylic resin segment were added dropwise in the flask over 90 minutes. After continuing the reaction for 60 minutes, the unreacted raw material monomers were removed under a reduced pressure (8 kPa). The amount of the removed monomers was very small compared with the monomers originally placed in the flask. Afterward, 0.8 mass parts of Ti $(OBu)_4$ were added as an esterification catalyst, and the temperature of the mixture was increased to 235° C. The reaction was made at a normal pressure (101.3 kPa) for 5 hours, and further, the reaction was made at a reduced pressure (8 kPa) for 1 hour.

After cooling the reaction mixture to 200° C., the reaction was made at a reduced pressure (20 kPa) for 1 hour to obtain a crystalline polyester resin (3). The crystalline polyester resin (3) is a hybrid resin formed with a styrene-acrylic resin. The content (HB ratio) of the styrene-acrylic resin segment with respect to 100 mass % of crystalline polyester resin (3) was 10 mass %. The crystalline polyester resin (3) had a number average molecular weight (Mn) of 6,400.

(Synthesis of Crystalline Polyester Resin (4)

A crystalline polyester resin (4) was obtained in the same manner as preparation of the crystalline polyester resin (1) except that the composition of the raw material monomers was changed to use: 241.5 mass parts of dodecanedioic acid and 62.1 mass parts of ethylene glycol. The obtained crystalline polyester resin (4) had a number average molecular weight (Mn) of 3,600.

(Preparation of Dispersion Liquid of Crystalline Polyester Resin Particles)

100 mass parts of the crystalline polyester resin (1) were dissolved in 400 mass parts of ethyl acetate. Then, 25 mass parts of 5 mass % sodium hydroxide aqueous solution were added thereto to make a resin solution. This resin solution was placed in a reaction vessel equipped with a stirrer. While stirring the resin solution, 400 mass parts of 0.26 mass % sodium lauryl sulfate aqueous solution were added over a period of 30 minutes. On the way of adding the sodium lauryl sulfate aqueous solution, the liquid in the reaction vessel became cloudy. All amount of the sodium lauryl sulfate aqueous solution was added dropwise, and it was obtained an emulsion dispersion liquid in which were uniformly dispersed the crystalline polyester resin particles containing 20% of solid fraction.

With respect to the crystalline polyester resins (2) to (4), there were similarly obtained emulsion dispersion liquids each containing 20% of solid fraction.

(Preparation of Dispersion Liquid of Amorphous Vinyl Resin Particles (1))

(1) First Step Polymerization

Into a reaction vessel equipped with a stirrer, a temperature sensor, a cooling tube and a nitrogen introducing device, 8 mass parts of sodium dodecyl sulfate and 3,000 mass parts of ion-exchanged water were charged. While stirring at a stirring speed of 230 rpm under nitrogen flow, the inner temperature was raised to 80° C.

After the temperature was raised, 10 mass parts of potassium persulfate (KPS) dissolved in 200 mass parts of ion-exchanged water were added thereto, and the liquid temperature was raised again to 80° C. The following monomer mixture was added dropwise thereto over 1 hour. Then, the mixture was heated to 80° C. for 2 hours. The polymerization was made with stirring. A dispersion liquid of amorphous vinyl resin particles (1H) was thus prepared.

Monomer mixture:

| | |
|---|---|
| Styrene (St) | 480 mass parts |
| n-Butyl acrylate (BA) | 250 mass parts |
| Methacrylic acid (MAA) | 68 mass parts |
| n-Octyl-3-mercaptopropionate | 16 mass parts |

(2) Second Step Polymerization

The monomer mixture described below was heated to 90° C. with stirring. To this mixture were dissolved 192 mass parts of pentaerythrytyl tetrabehenate as a releasing agent. Thus it was prepared a monomer mixture containing a releasing agent.

Monomer mixture:

| | |
|---|---|
| Styrene | 246.4 mass parts |
| n-Butyl acrylate | 118.6 mass parts |
| n-Octyl-3-mercaptopropionate | 1.44 mass parts |

Into a reaction vessel equipped with a stirrer, a temperature sensor, a cooling tube and a nitrogen introducing device, a solution of 7 mass parts of sodium polyoxyethylene-2-dodecyl ether sulfate dissolved in 800 mass parts of ion-exchanged water was charged. After heating the solution to 98° C., 260 mass parts of the above-described dispersion liquid of amorphous vinyl resin particles (1H) and the above-described monomer mixture containing a releasing agent were added. The solution was mixed and dispersed for 1 hour by using a mechanical disperser with a circulation route "CLEARMIX" (M Technique Co., Ltd.) so that a dispersion containing emulsion particles (oil particles) was prepared. Then, an initiator solution of 6 mass parts of potassium persulfate (KPS) dissolved in 200 mass parts of ion-exchanged water was added to the dispersion, and the system was heated and stirred at 80° C. for 1 hour to carry out polymerization. Thus, it was obtained a dispersion liquid of amorphous vinyl resin particles (1HM).

(3) Third Step Polymerization

Further, a solution of 11 mass parts of potassium persulfate (KPS) dissolved in 400 mass parts of ion-exchanged water was added to the dispersion liquid. The following monomer mixture was added dropwise thereto at 82° C. over 1 hour. After addition, the system was heated and stirred for 2 hours to carry out the polymerization), and then the system was cooled to 28° C. Thus it was obtained a dispersion liquid of amorphous vinyl resin particles (1).

Monomer mixture:

Styrene 428.1 mass parts n-Butyl acrylate 129.9 mass parts

Methacrylic acid 32.5 mass parts n-Octyl-3-mercaptopropionate 8.0 mass parts

An acid value of the obtained dispersion liquid of amorphous vinyl resin particles (1) was measured to be 18 mg KOH/g.

The acid value of the amorphous vinyl resin was measured based on the method described in JIS K0070-1966 (potentiometric titration). In the present measurement, a used solvent was a mixture of tetrahydrofuran and isopropyl alcohol having a volume ratio of 1:1.

(Preparation of Dispersion Liquid of Amorphous Vinyl Resin Particles (2))

A dispersion liquid of amorphous vinyl resin particles (2) was prepared in the same manner as preparation of the above-described dispersion liquid of amorphous vinyl resin particles (1) except that the monomer constitutions of the second step polymerization and the third step polymerization were changed as described below.

(Constitutions of the second step polymerization)

| | |
|---|---|
| Styrene | 232.6 mass parts |
| n-Butyl acrylate | 90.8 mass parts |
| Methacrylic acid | 19.4 mass parts |
| n-Octyl-3-mercaptopropionate | 1.44 mass parts |

(Constitutions of the third step polymerization)

| | |
|---|---|
| Styrene | 432.1 mass parts |
| n-Butyl acrylate | 121.9 mass parts |
| n-Octyl-3-mercaptopropionate | 8.0 mass parts |

(Preparation of Amorphous Polyester Resin (1))

In a reaction vessel equipped with a cooling tube, a stirrer, and a nitrogen introducing device were placed 316 mass parts of bisphenol A propylene oxide 2-mole adduct, 80 mass parts of terephthalic acid, and 34 mass parts of fumaric acid. Further, 2 mass parts of titanium tetraisopropoxide were added with 10 partitions as a poly condensation catalyst. The mixture was heated to 200° C. under nitrogen flow while removing water and the reaction was made for 10 hours. Subsequently, the reaction was made under a reduced pressure of 13.3 kPa (100 mmHg). When the softening point attained to 104° C., the produce was taken out. Thus it was obtained an amorphous polyester resin (1).

(Preparation of Dispersion Liquid of Amorphous Polyester Resin Particles)

An emulsion dispersion liquid of amorphous polyester resin (1) containing 20% of solid fraction was obtained in the same way as preparation of the above-described crystalline polyester resin (1).

(Preparation of Dispersion Liquid of Coloring Agent Particles (1))

(Pre-Treatment)

As a pigment of a coloring agent, C. I. Pigment Yellow 74 was arranged. This pigment was subjected to a pre-treatment of a vacuum heat treatment under the conditions of temperature 100° C. and a vacuum level of 13.3 Pa (0.1 torr).

(Dispersion)

90 mass parts of sodium lauryl sulfate were added to 1,600 mass parts of ion-exchanged water. While stirring this solution, 220 mass parts of the pre-treated C. I. Pigment Yellow 74 were gradually added. Subsequently, the solution was subjected to a dispersion treatment using a stirrer "CLEARMIX" (M Technique Co., Ltd.). Thus a dispersion liquid of coloring agent particles (P1) was obtained. The solid fraction of this dispersion liquid (P1) was 13.0%. A volume-based median diameter of the colorant agent particles in the dispersion liquid was 160 nm. A content of alkoxy aniline (2-methoxyaniline) in C. I. Pigment Yellow 74 was measured to be 300 mass ppm.

A content of alkoxy aniline was measured with the following method.

5 mg of toner sample was placed in a container (160 mL of volume) of an out gas collecting apparatus HM-04 (made by Japan Analytical Industry Co. Ltd.). Under a nitrogen gas flow at a flow rate of 200 mL/min, the temperature was raised from room temperature to 120° C. over a period of 10 min. The sample was kept at 120° C. for 50 min. The out gas emitted from the sample was collected with a heat-desorption collecting tube (AERO TDGL-Tube, made by GL Science Co. Ltd.) loaded with Tenax-GR as a primary adsorbing tube. Then, by using a heat-desorption apparatus JTD 505 (made by Japan Analytical Industry Co. Ltd.), the primary adsorbing tube was heated to 250° C. to collect the adsorbed gas to the primary adsorbing tube was collected by condensing to the secondary adsorbing tube cooled at −40° C.

A gas chromatography mass spectrometer GCMS-QP2010 (made by Shimadzu Co. Ltd.) was used for the measurement. The secondary adsorbing tube having collected the gas was hated to 280° C. with a Curie point method to carry out qualitative and quantitative analysis from MS (mass) and the peak area. A quantitative analysis of alkoxy aniline was done based on the calibration curve prepared beforehand from the mass and the peak area.

As a GC/MS column, it was used HP-1 MS (made by Agilent Technology Co. Ltd.) (length of 60 m, film pressure of 0.25 μm, and inner diameter of 0.25 mm). The temperature conditions of the column were as follows: it was kept at 40° C. for 4 min, then it was raised to 140° C. at a rate of 5° C./min, then it was raised to 240° C. at a rate of 10° C./min, then further it was raised to 290° C. at a rate of 25° C./min, and it was kept at 290° C. for 3 min.

(Preparation of Dispersion Liquid of Coloring Agent Particles (2))

A dispersion liquid of coloring agent particles (2) was prepared in the same manner as preparation of the above-described dispersion liquid of coloring agent particles (1) except that 2-ethoxy aniline was added to the pigment in an amount of 100 mass ppm.

(Preparation of Dispersion Liquid of Coloring Agent Particles (3))

A dispersion liquid of coloring agent particles (3) was obtained in the same manner as preparation of the dispersion liquid of coloring agent particles (1) except that 2-methoxyaniline was added to the pigment in an amount of 500 mass ppm.

(Preparation of Dispersion Liquid of Coloring Agent Particles (4))

A dispersion liquid of coloring agent particles (4) was obtained in the same manner as preparation of the dispersion liquid of coloring agent particles (1) except that the coloring agent was changed to a combination of C. I. Pigment Yellow 74 and C. I. Pigment Yellow 155 being subjected to the pre-treatment of 170° C. and vacuum level of 13.3 Pa (0.1 torr) with a mass ratio of 7:3.

(Preparation of Dispersion Liquid of Coloring Agent Particles (5))

A dispersion liquid of coloring agent particles (5) was obtained in the same manner as preparation of the dispersion liquid of coloring agent particles (1) except that the coloring agent was changed to C. I. Pigment Yellow 155 without subjected to the pre-treatment in place of C. I. Pigment Yellow 74.

(Preparation of Dispersion Liquid of Coloring Agent Particles (6))

A dispersion liquid of coloring agent particles (6) was obtained in the same manner as preparation of the dispersion liquid of coloring agent particles (5) except that 2-methoxyaniline was added to the pigment in an amount of 300 mass ppm, and an amount of C. I. Pigment Yellow 155 without subjected to the pre-treatment was increased.

(Preparation of Dispersion Liquid of Coloring Agent Particles (7)

A dispersion liquid of coloring agent particles (7) was obtained in the same manner as preparation of the dispersion liquid of coloring agent particles (1) except that C. I. Pigment Yellow 74 without subjected to the pre-treatment was used, and 2-methoxyaniline was added to the pigment in an amount of 200 mass ppm.

(Preparation of Dispersion Liquid of Coloring Agent Particles (8)

A dispersion liquid of coloring agent particles (8) was obtained in the same manner as preparation of the dispersion liquid of coloring agent particles (1) except that C. I. Pigment Yellow 74 without subjected to the pre-treatment was used, and 2-methoxyaniline was added to the pigment in an amount of 60 mass ppm.

(Preparation of Dispersion Liquid of Coloring Agent Particles (9))

A dispersion liquid of coloring agent particles (9) was obtained in the same manner as preparation of the dispersion liquid of coloring agent particles (1) except that the coloring agent was changed to a combination of C. I. Pigment Yellow 74 and C. I. Pigment Yellow 155 being subjected to the pre-treatment of 200° C. and vacuum level of 13.3 Pa (0.1 torr) with a mass ratio of 4:6.

(Preparation of Toner (1))

Into a reaction vessel equipped with a stirrer, a temperature sensor and a cooling tube, 180 mass parts (in solid fraction) of the dispersion liquid of the amorphous vinyl resin particles (1) and 2,000 mass parts of ion-exchanged water were charged. Thereafter, the pH was adjusted to 10 by adding 5 mol/L sodium hydroxide aqueous solution.

Further, there were 6.2 mass parts (in solid fraction) of the dispersion liquid of the coloring agent particles (1) were added. Then, while stirring, an aqueous solution of 60 mass parts of magnesium chloride dissolved in 60 mass parts of ion-exchanged water were added at 30° C. over a period of 10 minutes. After leaving the mixture for 3 minutes, 20 mass parts (in solid fraction) of the aqueous dispersion liquid of the crystalline polyester resin particles (1) were added over a period of 10 minutes. Then, the temperature of the system was raised to 82° C. over a period of 60 minutes, and the temperature was held at 82° C. to allow the particle growth reaction to continue.

While keeping this condition, the particle size of the aggregated particles was measured by using a "Coulter Multisizer 3" (Beckman Coulter, Inc.). When the volume based median particle size reached 6.0 μm, an aqueous solution containing 190 mass parts of sodium chloride dissolved in 760 mass parts of ion-exchanged water was added to terminate the particle growth. Then, the reaction system was further stirred at 74° C. to allow fusion of the particles to proceed. When the average circularity of the toner reached 0.957, the reaction system was cooled to 30° C. at a cooling rate of 2.5° C./min. The average circularity of the toner was measured by a measuring apparatus "FPIA-2100" (Sysmex Corp.) (HPF detect number of 4,000).

Then, solid-liquid separation was carried out, and a dewatered toner cake was washed by repeating re-dispersion in ion-exchanged water and solid-liquid separation for 3 times. Thereafter, the toner cake was dried at 40° C. for 24 hours to obtain toner mother particles.

To 100 mass parts of the obtained toner mother particles were added 0.6 mass parts of hydrophobic silica (number average primary particle size=12 nm, hydrophobicity=68) and 1.0 mass parts of hydrophobic titanium oxide (number average primary particle size=20 nm, hydrophobicity=63). The mixture was blended by using a "Henschel mixer" (Nippon Coke & Engineering Co., Ltd.) with a rotary blade circumferential speed of 35 mm/sec at 32° C. for 20 minutes. Thereafter, the coarse particles were removed with a sieve having a mesh of 45 μm. Thus, it was prepared a toner (1) treated with an external additive.

(Preparation of Toners (2) to (4) and (6) to (11))

Toners (2) to (4) and (6) to (11) each were prepared in the same manner as preparation of the toner (1) except that the constitution was changed as indicated in Table 1. In Table 1, PY74 indicates C. I. Pigment Yellow 74, and PY155 indicates C. I. Pigment Yellow 155.

(Preparation of Toner (5))

Into a reaction vessel equipped with a stirrer, a temperature sensor and a cooling tube, 160 mass parts (in solid fraction) of the dispersion liquid of the amorphous vinyl resin particles (2) and 2,000 mass parts of ion-exchanged water were charged. Thereafter, the pH was adjusted to 10 by adding 5 mol/L sodium hydroxide aqueous solution.

Further, 12.4 mass parts (in solid fraction) of the dispersion liquid of the coloring agent particles (1) were added. Then, while stirring, an aqueous solution of 60 mass parts of magnesium chloride dissolved in 60 mass parts of ion-exchanged water were added at 30° C. over a period of 10 minutes. After leaving the mixture for 3 minutes, 20 mass parts (in solid fraction) of the dispersion liquid of the crystalline polyester resin particles (1) were added over a period of 10 minutes. Then, the temperature of the system was raised to 82° C. over a period of 60 minutes, and the temperature was held at 82° C. to allow the particle growth reaction to continue.

While keeping this condition, the particle size of the aggregated particles was measured by using a "Coulter Multisizer 3" (Beckman Coulter, Inc.). When the volume based median particle size reached 6.0 μm, an aqueous solution containing 190 mass parts of sodium chloride dissolved in 760 mass parts of ion-exchanged water was added to terminate the particle growth. Then, the reaction system was cooled to 74° C. Then, 200 mass parts (in solid fraction) of the dispersion liquid of the amorphous polyester resin particles (1) were added over 20 minutes. The fusing of particles was proceeded. When the average circularity of the toner reached 0.957, the reaction system was cooled to 30° C. at a cooling rate of 2.5° C./min. The average circularity of the toner was measured by a measuring apparatus "FPIA-2100" (Sysmex Corp.) (HPF detect number of 4,000).

Toner (5) was prepared in the same manner as preparation of the toner (1). The acid value of the amorphous resin in the toner (5) in Table 1 was determined based on the method of JIS K0070-1992. The acid value of the amorphous resin represents an acid value obtained by adding the measured acid value: of each of the amorphous resin and amorphous polyester resin according to the ratio of the content of each resin.

TABLE 1

| Coloring agent No. | | | | | | | | | Crystalline polyester resin | | | Amorphous resin | | |
|---|---|---|---|---|---|---|---|---|---|---|---|---|---|---|
| | | | | | Alkoxy aniline in the pigment | | Alkoxy aniline added to the pigment | | | | | | | |
| Toner No. | Dispersion liquid No. | Pigment | Added amount to the toner (mass parts) | Pre-treatment | Content (mass ppm) | Alkyl portion | Added amount (mass ppm) | Alkyl portion | No. | Acid value (mg KOH/g) | Content in the toner particles (mass %) | Vinyl resin No. | Polyester resin No. | Acid value (mg KOH/g) |
| 1 | 1 | PY74 | 6.2 | Done | 300 | Methyl group | 0 | — | 1 | 20 | 10 | 1 | — | 18 |
| 2 | 2 | PY74 | 6.2 | Done | 300 | Methyl group | 100 | Ethyl group | 1 | 20 | 10 | 1 | — | 18 |
| 3 | 3 | PY74 | 6.2 | Done | 300 | Methyl group | 500 | Methyl group | 2 | 25 | 10 | 2 | — | 20 |
| 4 | 4 | PY74 PY155 | 6.2 (7:3) | Done | 90 | Methyl group | 0 | — | 1 | 20 | 30 | 1 | — | 18 |
| 5 | 1 | PY74 | 6.2 | Done | 300 | Methyl group | 0 | — | 3 | 15 | 10 | 2 | 1 | 25 |
| 6 | 5 | PY155 | 6.2 | Not done | 0 | — | 0 | — | 1 | 20 | 10 | 1 | — | 18 |
| 7 | 6 | PY155 | 10.0 | Not done | 0 | — | 300 | Methyl group | 1 | 20 | 10 | 1 | — | 18 |
| 8 | 1 | PY74 | 6.2 | Done | 300 | Methyl group | 0 | — | — | — | — | 1 | — | 18 |
| 9 | 7 | PY74 | 6.2 | Not done | 800 | Methyl group | 200 | Methyl group | 1 | 20 | 10 | 1 | — | 18 |
| 10 | 8 | PY74 | 6.2 | Not done | 800 | Methyl group | 60 | Methyl group | 1 | 20 | 10 | 1 | — | 18 |
| 11 | 9 | PY74 PY155 | 6.2 (4:6) | Done | 5 | Methyl group | 0 | — | 4 | 30 | 5 | 1 | — | 18 |

(Preparation of Developers (1) to (11))

100 mass parts of ferrite core and 5 mass parts of copolymer resin particles made of cyclohexyl methacrylate/methyl methacrylate (copolymerization ratio of 5:5) were placed in a high speed mixer provided with a stirring blade. The mixture was stirred at 120° C. for 30 minutes to form a resin coat layer on a surface of a ferrite core with a mechanical force effect. Thus it was obtained a carrier having a volume-based median diameter ($d_{50}$) of 35 μm.

The volume-based median diameter ($d_{50}$) of the carrier was measured by using a laser diffraction system particle size distribution meter "HELOS" (produced by SYMPATEC Co.) provided with a wet type dispersing apparatus. To the above-described carrier was added each of the toners (1) to (11) so that the content of the toner became to be 6 mass %. The mixtures each were loaded in a micro V-shape mixer (made bay Tsutsui Scientific Instrument Co. Ltd.), and they were mixed with a rotation rate of 45 rpm for 30 minutes to prepare developers (1) to (11).

[Evaluation]

(Evaluation of Low-temperature Fixability)

A fixing test was repeatedly conducted to fix a solid image having an amount of adhered toner of 11.3 g/m$^2$ under the conditions of constant temperature and humidity (temperature 20° C. and humidity 50%RH) . The fixing temperature was changed from 100° C. to 200° C. with a step of 5° C. The fixing tests were repeated until the moment of appearing cold offset. Here, in the evaluation test, "a fixing temperature" indicates a surface temperature of the fixing upper belt.

As an image-forming apparatus, it was used a multi-function printer "bizhub™ C754" (made by Konica Minolta, Inc.) with modifying the fixing device in such a manner that the surface temperature of the fixing upper belt and the fixing under roller was adjustable. In the modified image-forming apparatus, the fixing conditions were as follows: nip width of 11.2 mm; fixing time of 34 msec; and fixing pressure of 133 kPa. As a recording material for evaluation, "mondi Color Copy A4 90 g/m$^2$" (made by Mondi Co. Ltd.) was used.

The lowest surface temperature without producing cold offset in each test was checked. This temperature was recorded as a lowest fixing temperature. When the lowest fixing temperature is smaller, it indicates that it is excellent in the low-temperature fixability. In the present evaluation, when the lowest fixing temperature was 160° C. or less, it was decided that the developer passed the examination.

(Evaluation of Scattering Property)

As an evaluation apparatus, it was used a modified multi-function printer "bizhub™ C754" (made by Konica Minolta, Inc.). After making 100,000 sheets of prints, the developing device was taken out, and it was set to a rotary device. An A4 white paper was set under the developing sleeve by locating the position of the developing sleeve in the center of the paper.

The developing sleeve was rotated for 60 minutes, and the mass (mg) of the fallen toner (toner scattering amount) was measured to evaluate. The rotation circumferential speed of the developing sleeve was made to be 620 mm/sec. When the toner scatting amount was 9 mg or less, it was decided that the developer passed the examination.

(Evaluation of Image Density)

A test chart for measurement of a reflecting density was formed with a modified multi-function printer "bizhub™ C754" under the same conditions as used for the evaluation of low-temperature fixability. The test chart was formed with an amount of adhered toner of 3.0 g/m$^2$ on the recording paper. The fixing temperature was set to be "the lowest fixing temperature+10° C". The lowest fixing temperature was the value obtained in the evaluation of low-temperature fixability. A neutral reflecting density of the produced test chart was measured with a densitometer PDA-65 (made by Konica Minolta, Inc.). When the measured density was larger, the developer was evaluated to be excellent in col oring power. The sample that produced the reflecting density of 1.0 or more was decided to pass the examination.

The evaluation results are listed in the following Table 2.

TABLE 2

| Toner No. | Content of alkoxy aniline (mass ppm) | Low-temperature fixability Lowest fixing temperature (° C.) | Scattering property Toner scattering amount (mg) | Coloring power Image density | Remarks |
|---|---|---|---|---|---|
| 1 | 15.1 | 150 | 3 | 1.2 | Inv. |
| 2 | 25.3 | 155 | 5 | 1.2 | Inv. |
| 3 | 48.6 | 145 | 7 | 1.2 | Inv. |
| 4 | 5.6 | 130 | 8 | 1.0 | Inv. |
| 5 | 14.8 | 140 | 5 | 1.2 | Inv. |
| 6 | 0 | 165 | 2 | 0.6 | Comp. |
| 7 | 15.9 | 160 | 15 | 0.9 | Comp. |
| 8 | 15.5 | 180 | 6 | 1.2 | Gomp. |
| 9 | 60.2 | 150 | 16 | 1.2 | Comp. |
| 10 | 52.0 | 140 | 11 | 1.2 | Comp. |
| 11 | 0.1 | 160 | 9 | 1.0 | Inv. |

Inv.: Inventive example
Comp.: Comparative example

As indicated in Table 2, the toners (1) to (5) and (11) have small amount of toner scattering, and they are excellent in low-temperature fixability and coloring power. The toners (1) to (5) and (11) each contain: an amorphous resin including an amorphous vinyl resin; a crystalline resin; a coloring agent including C. I. Pigment 74; and alkoxy aniline in the range of 0.1 to 50.0 mass ppm contained in the toner particles.

What is claimed is:

1. An electrostatic image developing toner comprising toner particles containing: an amorphous resin including an amorphous vinyl resin; and a crystalline resin, wherein the toner particles contain: a coloring agent including C. I. Pigment Yellow 74; and alkoxy aniline with an amount in the range of 0.1 to 50.0 mass ppm in the toner particles.

2. The electrostatic image developing toner described in claim 1, wherein the toner particles further contain at least one selected from the group constituting of C. I. Pigment Yellow 93, C. I. Pigment Yellow 155, C. I. Pigment Yellow 180, C. I. Pigment Yellow 185, C. I. Solvent Yellow 93, and C. I. Solvent Yellow 163 together with C. I. Pigment Yellow 74.

3. The electrostatic image developing toner described in claim 1, wherein the crystalline resin contains a crystalline polyester resin, and a content of the crystalline polyester resin in the toner particles is in the range of 5 to 30 mass %.

4. The electrostatic image developing toner described in claim 3, wherein the crystalline polyester resin is a hybrid resin composed of a crystalline polyester resin and an amorphous resin.

5. The electrostatic image developing toner described in claim 3, wherein the crystalline polyester resin has an acid value in the range of 15 to 30 mg KOH/g.

6. The electrostatic image developing toner described in claim 1, wherein the alkoxy aniline is 2-methoxyaniline.

7. The electrostatic image developing toner described in claim 1, wherein the toner particles further contain an amorphous polyester resin as the amorphous resin.

* * * * *